US007716911B2

(12) United States Patent
Namiki et al.

(10) Patent No.: US 7,716,911 B2
(45) Date of Patent: May 18, 2010

(54) BALL CHAIN AND METHOD OF MANUFACTURING THE SAME

(75) Inventors: Norio Namiki, Kazo (JP); Hiroji Takahashi, Kazo (JP)

(73) Assignee: Namiki Co., Ltd., Saitama-ken (JP)

( * ) Notice: Subject to any disclaimer, the term of this patent is extended or adjusted under 35 U.S.C. 154(b) by 0 days.

(21) Appl. No.: 12/323,875

(22) Filed: Nov. 26, 2008

(65) Prior Publication Data

US 2009/0183488 A1 Jul. 23, 2009

(30) Foreign Application Priority Data

Jan. 21, 2008 (JP) ..... 2008-010267

(51) Int. Cl.
*F16G 13/12* (2006.01)
*B21L 11/00* (2006.01)

(52) U.S. Cl. ..... 59/2; 59/35.1; 59/80

(58) Field of Classification Search ..... 59/2, 59/35.1, 78, 80

See application file for complete search history.

(56) References Cited

U.S. PATENT DOCUMENTS 408,314 A * 8/1889 Moore ..... 59/2
1,087,876 A * 2/1914 Goodridge et al. ..... 59/2
1,548,677 A * 8/1925 Goodridge et al. ..... 59/2
1,693,558 A * 11/1928 Durr ..... 59/2
3,685,284 A * 8/1972 Taubner, Jr. ..... 59/80

FOREIGN PATENT DOCUMENTS

| | | | |
|---|---|---|---|
| GB | 2188261 | * | 9/1987 |
| JP | 62-227546 | | 10/1987 |
| JP | 2003-025041 | | 1/2003 |
| JP | 2005-192838 | | 7/2005 |

OTHER PUBLICATIONS

Japanese Office Action in corresponding foreign application mailed Aug. 28, 2009 with English language translation.

* cited by examiner

*Primary Examiner*—David B Jones
(74) *Attorney, Agent, or Firm*—Harness, Dickey & Pierce, PLC

(57) ABSTRACT

A ball chain including metal balls with a small wall thickness and can withstand a large tensile load are provided. A method of manufacturing the same includes rounding a piece of metal to form rotation-axis symmetric bodies (22) and connecting the rotation-axis symmetric bodies (22) in a chain-like manner with connecting shafts. Each of the connecting shafts has connecting heads on both end portions. Each of the rotation-axis symmetric bodies (22) has a butt seam (24) in a direction of a rotation axis of the rotation-axis symmetric body and a weld part (25) at least one part of the butt seam (24).

8 Claims, 4 Drawing Sheets

BALL CHAIN AND METHOD OF MANUFACTURING THE SAME

CROSS-REFERENCE TO RELATED APPLICATIONS

This application is based upon and claims the benefit of priority from prior Japanese Patent Application No. 2008-10267, filed Jan. 21, 2008, the entire contents of which are incorporated herein by reference.

BACKGROUND OF THE INVENTION

1. Field of the Invention

The present invention relates to a ball chain and a method of manufacturing the same, wherein the ball chain is provided by hollow metal balls connected in a chain-like manner by connecting shafts, each of the connecting shafts having connecting heads on both end portions.

2. Description of Related Art

FIG. 5 is a partly cross-sectional view of a conventional ball chain shown as a broken portion.

A conventional ball chain 31 has a plurality of hollow metal balls 32 and is provided by connecting connecting shafts 33 in a chain-like manner, each of the connecting shafts 33 having connecting heads 33*a* on both end portions, as shown in FIG. 5.

Each of the metal balls 32 is provided by rounding a piece of metal to form a shape of a hollow sphere and has a butt seam 34 of the metal piece.

At the upper and lower end portions the butt seam 34, apertures are provided.

Through each aperture a shaft portion of the connecting shaft 33 is inserted, and the connecting heads 33*a* on both ends of the connecting shaft 33 are formed bulged to have a larger diameter than the inner diameter of the aperture.

The connecting heads 33*a* of the connecting shaft 33 and the apertures of the metal balls 32 are engaged so that the connecting shaft 33 cannot come off the aperture.

By continuously forming such structure, each of the metal balls 32 are connected by the connecting shafts 33 in a chain-like manner.

REFERENCES

Japanese Patent Document 1:
Official Gazette of Japanese Patent Application Publication No. 2003-25041
Japanese Patent Document 2:
Official Gazette of Japanese Patent Application Publication No. 2005-192838

BRIEF SUMMARY OF THE INVENTION

Problems to be Solved by the Invention

However, in the conventional ball chains, because a metal tape with a small wall thickness is simply formed into a spherical shape with the aforementioned connecting heads of the connecting shafts contained therein, the seam of the metal ball was occasionally opened to allow the connecting head to come off when a large tensile load is applied.

Conceivably a metal tape with a large wall thickness could be formed into the shape of a metal ball to withstand a large tensile load, but the processing would be difficult, and the gross weight of the ball chain would be increased, and also more materials would be required.

In order to solve the problems, the invention of the present application provides a ball chain and a method of manufacturing the same, wherein the ball chain is provided by metal balls with a small wall thickness and can withstand a large tensile load.

Conceivably if the seam of the metal ball of a ball chain can be bonded by some adhering or welding technologies, the obtained ball chain would comprise metal balls with a small wall thickness and would be able to withstand a large tensile load.

However, adhesion lacks reliability, and welding has not traditionally used in bonding between metals with a small wall thickness because the welding heat input is generally high.

On the other hand, laser welding technologies have been evolved in recent years, and, because of the lower heat input, it is known that such laser welding is preferred for welding of a limited part between metals and welding between thin-wall metals.

However, while laser welding is preferred for welding of a limited part between metals, the characteristics of laser welding require precise laser irradiation on the weld area.

In the case of ball chains, because the metal balls comprised in a ball chain have broadly a shape of a sphere and, in addition, each metal ball is freely rotatable, positioning of the butt seam of the metal ball is unstable, and consequently precise laser irradiation on the butt seam of the metal ball is almost impossible. In the process of shape forming of a ball chain, a metal tape is formed into a tubular shape in the first place, and said metal tube is rotated about its central axis thereafter and passed through metal molds that are engaging with each other to be gradually formed into a shape of a row of metal balls, and in this process, the metal tube or the butt seam of the metal ball constantly moves, and consequently precise laser irradiation on the butt seam has been very difficult.

The aforementioned situation also applies to TIG welding although the technology of welding with its heat input controlled has been recently evolved, because accurate alignment with the weld part, arc distance control, etc., are required, and consequently performing TIG welding exactly on the butt seam of a metal ball of a ball chain has been very difficult.

In order to solve the problems, the invention of the present application provides a ball chain and a method of manufacturing the same, wherein the ball chain comprises metal balls with a small wall thickness and can withstand a large tensile load by performing laser welding or TIG welding precisely on the butt seam of a metal tube.

Means for Solving the Problems

In a ball chain obtained by rounding a piece of metal to form metal, hollow and rotation-axis symmetric bodies and connecting said rotation-axis symmetric bodies in a chain-like manner with connecting shafts, each of the connecting shafts having connecting heads on both end portions, the ball chain according to the invention of the present application is characterized in that each of said rotation-axis symmetric bodies has a butt seam in a direction of a rotation axis of the rotation-axis symmetric body and a weld portion at at least one part of said butt seam.

Preferably, said rotation-axis symmetric bodies are hollow balls.

Said weld portion of the butt seam can be made to be positioned in the proximity of an aperture of each of said rotation-axis symmetric bodies through which said connecting shafts are inserted.

The method of manufacturing a ball chain according to the invention of the present application is characterized by comprising the steps of:

passing a metal wire through a connecting shaft metal mold to form a shape of a connecting shaft wire in which connecting shafts are joined together in a linear fashion;

delivering a metal tape and said connecting shaft wire to a drawing die having a positioning means for determining positioning of a feed-in position of said connecting shaft wire and a feed-in position and a feed-in angle of a metal tape;

drawing said metal tape using said drawing die to form a metal tube with said connecting shaft wire contained therein after said metal tape and said connecting shaft wire are rotated by a predetermined angle at a time with respect to said connecting shaft wire;

welding a butt seam of said metal tube by irradiating a laser, or by performing TIG welding, on said butt seam in synchronization with a rotation of said metal tube when said butt seam of said metal tube is rotated to a predetermined position;

forming said metal tube into a shape of a ball chain structure in which a plurality of rotation-axis symmetric bodies are joined together in a linear fashion, said rotation-axis symmetric bodies respectively containing connecting heads of each connecting shaft of said connecting shaft wire, by delivering said metal tube and said connecting shaft wire into a rotation-axis-symmetric-body forming metal mold and rotating said metal tube and said connecting shaft wire by a predetermined angle at a time; and separating a joint of each rotation-axis symmetric body of said ball chain structure and a joint of each connecting shaft of said connecting shaft wire.

A timing of said irradiating of a laser, or said TIG welding, and a feeding timing and pitch of said metal tube can be made to synchronize with each other so that said butt seam is welded in the proximity of an aperture of each rotation-axis symmetric body through which said connecting shaft is inserted.

The method of manufacturing a ball chain according to the invention of the present application is characterized by comprising the steps of:

passing a metal wire through a connecting shaft metal mold to form a shape of a connecting shaft wire in which connecting shafts are joined together in a linear fashion;

delivering a metal tape and said connecting shaft wire to a drawing die having a positioning means for determining positioning of a feed-in position of said connecting shaft wire and a feed-in position and a feed-in angle of a metal tape;

drawing said metal tape using said drawing die to form a metal tube with said connecting shaft wire contained therein after said metal tape and said connecting shaft wire are rotated by a predetermined angle at a time with respect to said connecting shaft wire;

welding a butt seam of said metal tube using a laser welding torch, or a TIG welding torch, which rotates together with a rotation of said drawing die and performs welding from a constant position relative to said drawing die;

forming said metal tube into a shape of a ball chain structure in which a plurality of the rotation-axis symmetric bodies are joined together in a linear fashion, said rotation-axis symmetric bodies respectively containing connecting heads of each connecting shaft of said connecting shaft wire, by delivering said metal tube and said connecting shaft wire into a rotation-axis-symmetric-body forming metal mold and rotating said metal tube and said connecting shaft wire by a predetermined angle at a time; and separating a joint of each rotation-axis symmetric body of said ball chain structure and a joint of each connecting shaft of said connecting shaft wire.

Said butt seam of the metal tube can be made to be welded continuously or intermittently.

Effect of the Invention

In the ball chain according to the present invention, a rotation-axis symmetric body has a butt seam in a direction of a rotation axis of the rotation-axis symmetric body and a weld portion at at least one part of said butt seam. Consequently, the butt seam is not opened when a tensile load is applied to the ball chain because of the weld portion, thus no coming off of a connecting head of a connecting shaft and greatly withstanding a large tensile load compared to a ball chain formed by simply rounding a piece of metal to form a configuration of a rotation-axis symmetric body That is, the wall thickness of the ball chain can be thin for an inevitable tensile load, and thus a ball chain with easy processing and reasonable cost of materials can be obtained.

Particularly, in the case of positioning the weld portion of the butt seam in the proximity of an aperture of the rotation-axis symmetric body through which the connecting shaft is inserted, the tensile load capacity can effectively be increased by less welding, and thus a ball chain with easy processing and reasonable cost can be obtained.

In the method of manufacturing a ball chain according to the present invention, a metal tape and a connecting shaft wire are delivered to a drawing die, and the metal tape and the connecting shaft wire are rotated by a predetermined angle at a time, and then using the drawing die the metal tape is drawn to form a metal tube with the connecting shaft wire contained therein.

The butt seam is welded by performing laser welding or TIG welding on the butt seam in synchronization with a rotation of the metal tube before the metal tube is formed into a shape of a ball chain structure subsequently and after the metal tube comes out of the drawing die.

Because the butt seam of the metal tube is provided at a constant distance in the radial direction compared to the butt seam of the rotation-axis symmetric body, the focal distance of the irradiated laser is constant, and thus precise concentration of the laser energy is possible. Also in the case of TIG welding, because the welding area of the butt seam of the metal tube is positioned at a constant distance in the radial direction, a distance between a TIG welding torch and the weld part can be properly maintained, and thus welding can be performed appropriately.

In addition, according to the present invention, because a positioning means determines the constant positioning of the feed-in position of the connecting shaft wire and the feed-in position and the feed-in angle of the metal tape with respect to the drawing die, the position of the butt seam in the circumferential direction can be precisely controlled with respect to the rotation of the drawing die and the metal tube. Consequently, in the case of synchronizing the timing of laser welding or TIG welding with the rotation of the drawing die, the laser welding or TIG welding can be precisely performed on the position of the butt seam in the circumferential direction.

Consequently, intermittent welding on the butt seam can be suitably performed.

In addition, by synchronizing the feeding speed and pitch of the metal tube with the timing of the laser welding or TIG welding, the butt seam can be welded at a desired location.

Particularly, by synchronizing the feeding speed and pitch of the metal tube, the timing of the laser welding or TIG welding, and the subsequent step of forming a shape of a ball chain structure, laser welding or TIG welding can be performed in the proximity of the concaved portion of each rotation-axis symmetric body comprised in the ball chain structure, i.e. the portion that is to become an aperture of the rotation-axis symmetric body through which the connecting shaft is inserted.

Additionally, in the method of manufacturing a ball chain according to the present invention, a laser welding torch or a TIG welding torch is fixed to a constant position relative to the drawing die to be able to rotate together with a rotation of the drawing die.

According to this manufacturing method, continuous irradiation or emission in laser welding or TIG welding on the butt seam can be suitably performed.

That is, because the positioning means determines the constant positioning of the feed-in position of the connecting shaft wire and the feed-in position and the feed-in angle of the metal tape with respect to the drawing die, and the laser welding torch or TIG welding torch is fixed to a constant position relative to the drawing die, laser welding or TIG welding can be performed precisely on the position of the butt seam in the circumferential direction of the metal tube, and, in the case of performing the welding continuously, the butt seam in the circumferential direction of the metal tube can be welded continuously.

Needless to add that the butt seam can be welded intermittently by allowing the welding to be performed intermittently.

Regarding a metal tape which is generally reeled out from a metal tape reel in which the metal tape is wound around a reel, because the metal tape reel is fixed in place and reels out a metal tape, if no positioning means is provided, the metal tape reel serves as an anchor when the drawing die rotates by a predetermined angle at a time, thus shifting the feed-in position and the feed-in angle of the metal tape with respect to the drawing die, thereby shifting the circumferential position, with respect to the drawing die, of the butt seam of the metal tube formed by drawing by the drawing die. In such case, laser welding or TIG welding cannot be performed precisely on the position, in the circumferential direction, of the butt seam of the metal tube.

Because of the positioning means that allows the circumferential position, with respect to the drawing die, of the butt seam of the metal tube formed by drawing by the drawing die to be always constant in the present invention, laser welding or TIG welding can be performed precisely on the position, in the circumferential direction, of the butt seam of the metal tube, as described above.

DETAILED DESCRIPTION OF THE INVENTION

In the next place, an embodiment of a ball chain and a method of manufacturing the same according to the present invention will be described hereinafter.

Figure 1:
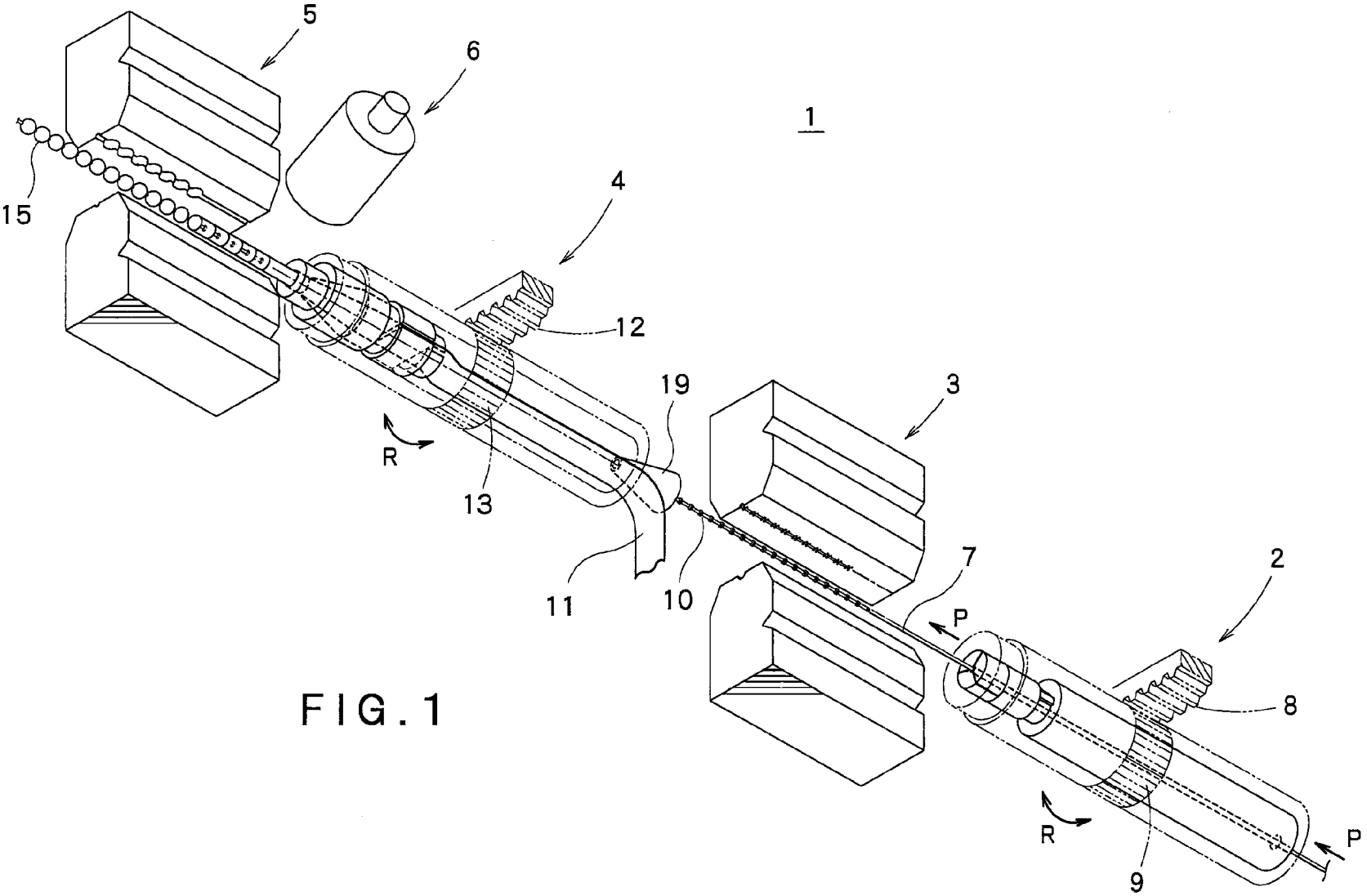
FIG. 1 is a structural diagram showing an overall structure of a ball chain manufacturing apparatus for implementing a manufacturing method of the present invention.

FIG. 1 shows the entire body of an apparatus for manufacturing a ball chain according to the present invention.

The ball chain manufacturing apparatus 1 has a wire feeder 2, a connecting shaft metal mold 3, a drawing die 4, a rotation-axis-symmetric-body forming metal mold 5, and a laser welding torch or TIG welding torch 6.

Note that the laser welding torch or TIG welding torch 6 is hereinafter representatively referred to as a laser welding torch 6 and descriptions will be made by exemplifying laser irradiation, but the laser welding torch may be replaced by the TIG welding torch and the laser irradiation may be replaced by the energy input for TIG welding.

The reference numeral 7 shows a wire as a material that makes connecting shafts of the ball chain. The wire 7 is fed to a feeding direction P.

The wire feeder 2 can hold the wire 7 to feed by a predetermined pitch and can rotate in a rotation direction R by a predetermined angle at a time through a rack and pinion 8 and 9.

The wire 7 is fed in the feeding direction P by the wire feeder 2, rotated by a predetermined angle at a time, fed to the connecting shaft metal mold 3, and, by repetitive engagement of the connecting shaft metal mold 3, formed into the shape of a connecting shaft wire 10 in which the connecting shafts are joined together in a linear fashion. The term=the connecting shafts are joined together in a linear fashion=indicates that the connecting shafts are joined together with their connecting heads flush against each other. The connecting shaft wire 10 is to be separated into individual connecting shafts by applying an external force such as bending whereby the slits between the adjacent connecting heads are separated.

The reference numeral 11 shows a metal tape that makes a material of rotation-axis symmetric bodies comprised in the ball chain.

After the wire 7 is formed into the shape of the connecting shaft wire 10, the metal tape 11 is delivered with the connecting shaft wire 10 to the drawing die 4.

With the connecting shaft wire 10 and the metal tape 11 still held, the drawing die 4 can rotate in the rotation direction R by a predetermined angle at a time through a rack and pinion 12 and 13 and draw the metal tape 11 to form a metal tube 14.

The rotation of the rack and pinion 12 and 13 is synchronized with that of the rack and pinion 8 and 9 so that with the same angle and direction the rotation is made by a predetermined angle at a time.

This allows the metal tube 14 and the connecting shaft wire 10 thereinside to rotate by a predetermined angle at a time with the same angle and direction, to be fed to the rotation-axis-symmetric-body forming metal mold 5, and, by repetitive engagement of the rotation-axis-symmetric-body forming metal mold 5, to be formed into the shape of a ball chain structure 15 in which the rotation-axis symmetric bodies are joined together in a linear fashion.

The rotation-axis symmetric body in this case indicates a body that is approximately symmetric about a rotation axis and has a hollow, including a sphere, solid of revolution and polytope.

In feeding the connecting shaft wire 10 and the metal tube 14, the relative position to each other and the feeding pitch are adjusted in such a way that each of the rotation-axis symmetric bodies of the ball chain structure 15 shaped in the rotation-axis-symmetric-body forming metal mold 5 contains the connecting heads of the connecting shafts therein.

The drawing die 4 has a positioning means thereinside for determining the positioning of the feed-in position of the connecting shaft wire 10 and the feed-in position and angle of the metal tape 11.

Figure 2:
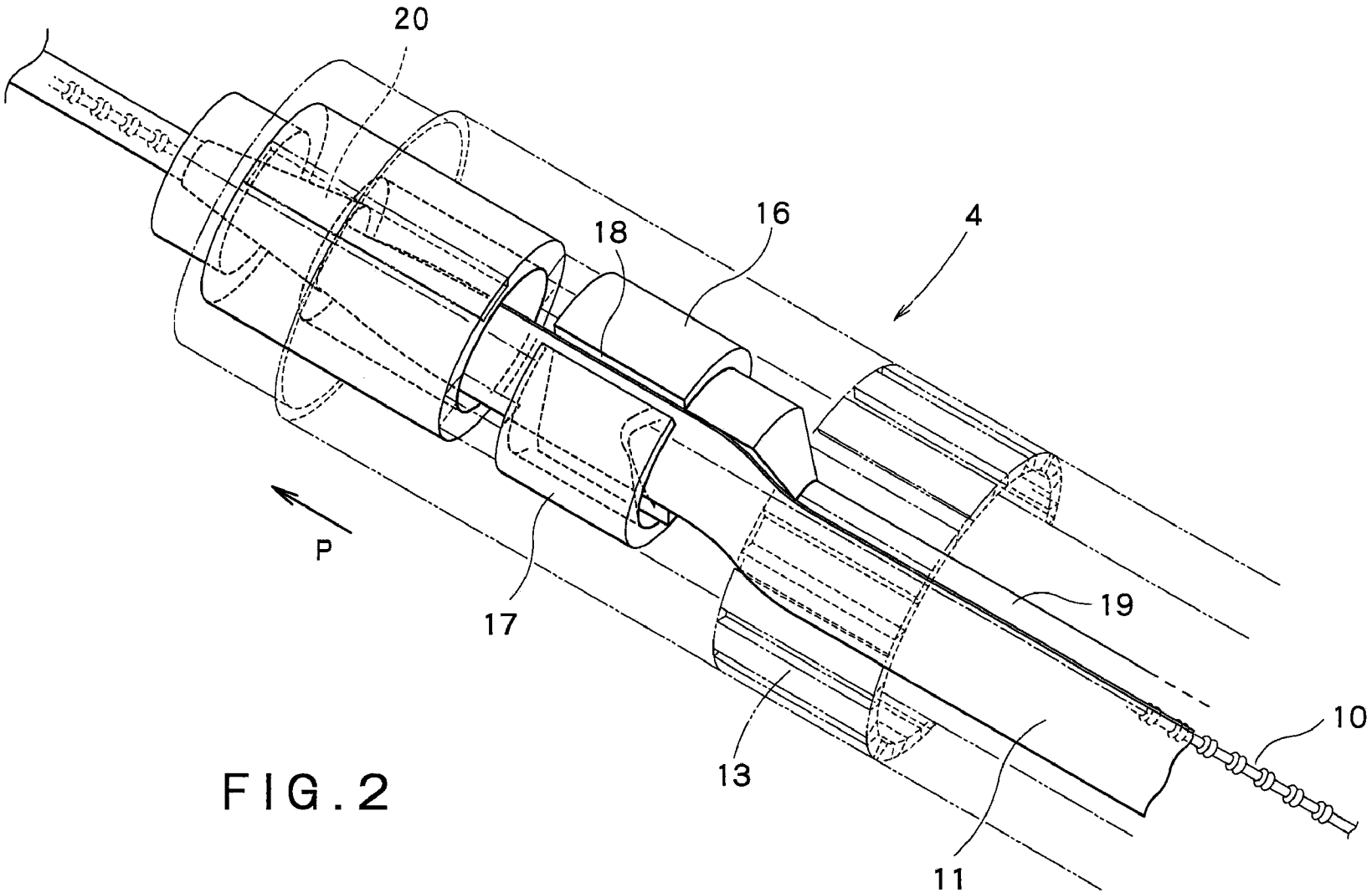
FIG. 2 is an enlarged perspective diagram showing a positioning means of a drawing die and a drawing portion of the ball chain manufacturing apparatus of the present invention.

The details of the above positioning means and a drawing portion are shown in FIG. 2.

The positioning means has an upper crescent member 16 and a lower crescent member 17.

A main body of the drawing die 4 has a cylindrical member, and the upper crescent member 16 and the lower crescent member 17 are fixed to an inner surface of the cylindrical member of the main body of the drawing die 4, respectively.

Between the upper crescent member 16 and the lower crescent member 17 there is an interspace 18 into which the metal tape 11 is guided.

By guiding the metal tape 11 into the interspace 18, the positioning of the feed-in position of the metal tape 11 i.e. the position in a radial direction with respect to the drawing die 4 and the feed-in angle of the metal tape 11 are determined.

The term, feed-in angle, indicates the angle of the metal tape 11 in cross-section perpendicular to the feeding direction P, and preferably the metal tape 11 is fed in to the base of an isosceles triangle about the center of the drawing die 4 is preferred.

Meanwhile, a guide tube 19 for the connecting shaft wire 10 is fixed to the upper crescent member 16.

The end of the guide tube 19 has a trumpet-like shape protruding outside the drawing die 4 so that the connecting shaft wire 10 is easily received (refer to FIG. 1).

Due to the guiding by the guide tube 19, the positioning of the feed-in position of the connecting shaft wire 10 i.e. the position in a radial direction with respect to the drawing die 4 is determined.

Preferably the connecting shaft wire 10 is fed in to the center of the drawing die 4 in cross-section perpendicular to the feeding direction P. At the back side (downstream) of the upper crescent member 16 and the lower crescent member 17 with respect to the feeding direction P, a drawing portion 20 is provided.

An inner surface of the drawing portion 20 is funnel-like, and the metal tape 11 is guided to this inner surface to be drawn to form a metal tube 14 with the connecting shaft wire 10 contained therein.

Because the positioning of the feed-in angle, particularly, of the metal tape 11 is determined by the interspace 18 of the positioning means immediately before the drawing portion 20, a butt seam of the metal tube 14 that has come out of the drawing portion 20 is positioned at a constant position in a circumferential direction of the metal tube 14.

Although the drawing die 4 rotates by a predetermined angle at a time as previously described, the feed-in position and the feed-in angle of the metal tape 11 are fixed with respect to the drawing die 4, and thus the butt seam of the metal tube 14 is drawn out from a constant position with respect to the drawing die 4.

In the present invention, laser welding is performed on the butt seam of the metal tube 14 before entering the rotation-axis-symmetric-body forming metal mold 5 and after coming out of the drawing die 4.

In the case of having the TIG welding torch, TIG welding is performed.

As shown in FIG. 1, the laser welding torch 6 is provided between the drawing die 4 and the rotation-axis-symmetric-body forming metal mold 5 and, in the present embodiment, structured to be fixed at a constant position with respect to the ground or a pedestal and to irradiate a laser against the metal tube 14 drawn out of the drawing die 4.

The laser welding torch 6 is structured to be synchronized with the rotation of the metal tube 14 i.e. the rotation of the drawing die 4 and, when the butt seam of the metal tube 14 is rotated to a predetermined position, to irradiate a laser on the butt seam of the metal tube 14 to weld said butt seam.

While control for the synchronization is not specifically shown in the drawings, the control can be exercised by a control device which can be properly provided by those skilled in the art and which performs an overall control over a device for activating the feed of the wire 7, the feed of the metal tape 11, the rotation of the drawing die 4 and the wire feeder 2, the laser irradiation, and the engaging operation of the connecting shaft metal mold 3 and the rotation-axis-symmetric-body forming metal mold 5. The control may not necessarily be performed individually for each of all the mechanisms with a software-type control but can also be performed over a combination of a mechanism for the feed of the wire 7 or the metal tape 11, a mechanical interlock for the rotation mechanisms of the drawing die 4 and the wire feeder 2, and a software-type interlock for controlling dynamic force input for a laser welding torch or TIG welding torch.

In the present embodiment, the laser irradiation by the laser welding torch 6 is performed preferably intermittently.

Figure 3:
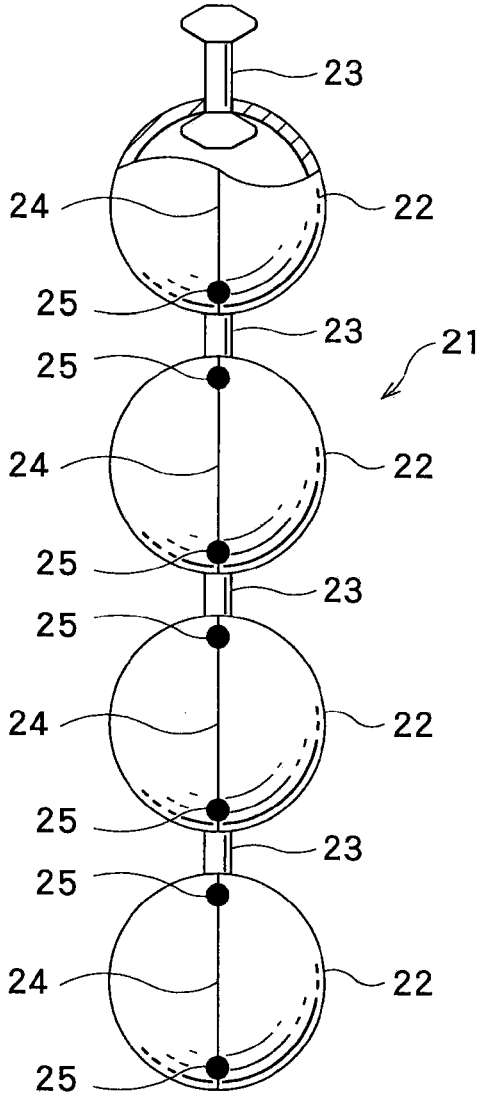
FIG. 3 is a perspective diagram showing a segment of a ball chain exemplifying a laser welding according to the present invention.
Figure 4:
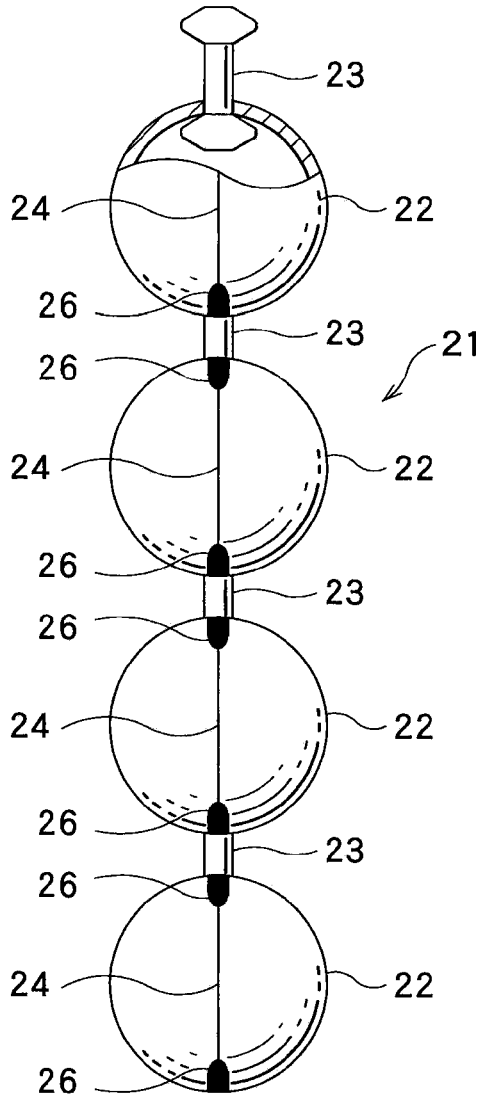
FIG. 4 is a perspective diagram showing a segment of a ball chain exemplifying another laser welding according to the present invention.
Figure 5:
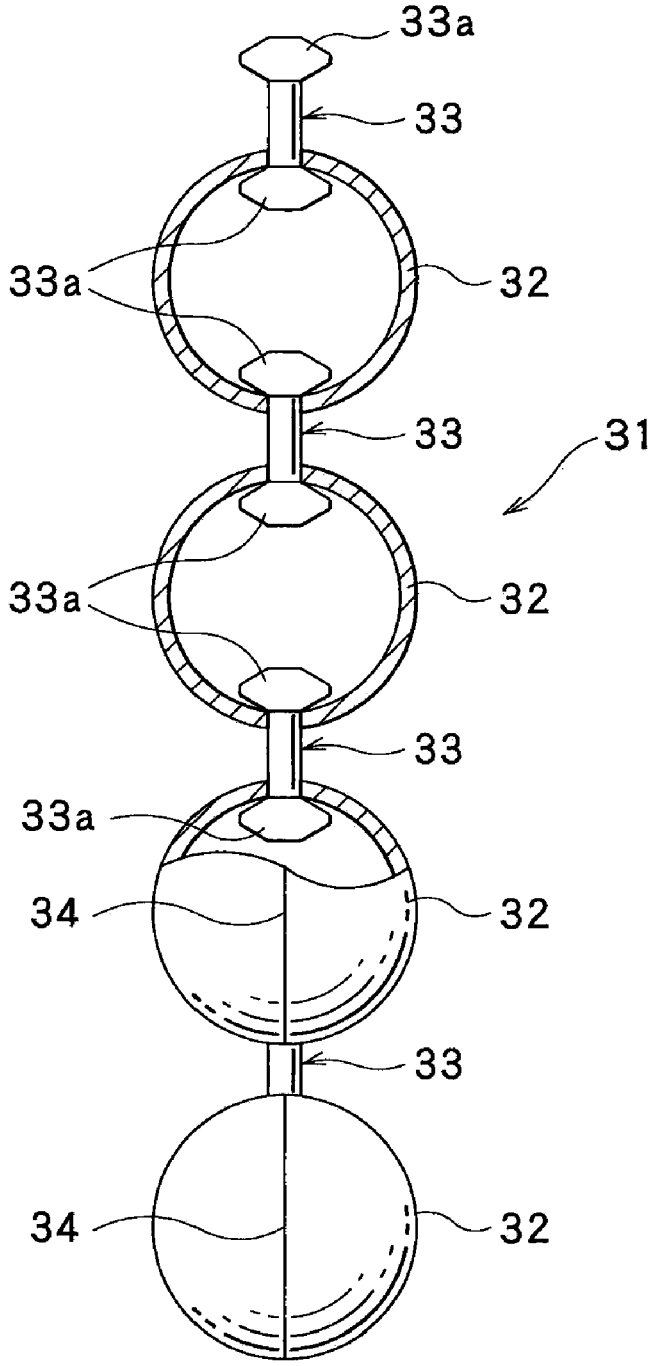
FIG. 5 is a perspective diagram showing a segment of a conventional ball chain.

FIGS. 3 and 4 show examples of welding with a laser.

In FIGS. 3 and 4, the reference numerals 21, 22, and 23 show a ball chain, a rotation-axis symmetric body, and a connecting shaft, respectively.

The reference numeral 24 shows a butt seam of the rotation-axis symmetric body 22.

The reference numerals 25 and 26 show weld parts by laser welding.

In the example in FIG. 3, at the stage of the metal tube 14, two weld parts 25 are provided apart from each other on both sides of the spot that will become a joint of two rotation-axis symmetric bodies 22 that will later be adjacent to each other, and thereafter the rotation-axis symmetric bodies 22 are formed.

In the example in FIG. 4, at the stage of the metal tube 14, the weld part 26 which is somewhat long is provided to extend over a joint of two rotation-axis symmetric bodies 22 that will later be adjacent to each other, and thereafter the rotation-axis symmetric bodies 22 are formed, and then the weld part 26 is split at the joint of the rotation-axis symmetric bodies 22 to provide weld parts in the proximity of apertures for the connecting shaft 23 of the two rotation-axis symmetric bodies 22 adjacent to each other.

As shown in FIG. 1, by allowing a laser to be irradiated on the butt seam of the metal tube 14 between the drawing die 4 and the rotation-axis-symmetric-body forming metal mold 5, precise concentration of the laser energy is possible because the butt seam of the metal tube 14 is provided at a constant distance in the radial direction, thereby the focal distance of the irradiated laser being constant.

This is to be proved by comparison with a case of irradiating a laser after the rotation-axis-symmetric-body forming metal mold 5.

That is, after the rotation-axis-symmetric-body forming metal mold 5, the position of the region to be laser-irradiated in the radial direction is changed by the concave of the rotation-axis symmetric body, and thus the energy of a laser is difficult to be precisely concentrated.

In addition, according to the present invention, because the upper crescent member 16 and the lower crescent member 17 of the positioning means determine the constant positioning of the feed-in position of the connecting shaft wire 10 and the feed-in position and the feed-in angle of the metal tape 11 with respect to the drawing die 4, the position of the butt seam of the metal tube 14 drawn out of the drawing die 4 in the circumferential direction is always constant with respect to the drawing die 4.

That is, the position of the butt seam in the circumferential direction will not be misaligned attributable to torsion of the metal tube 14.

By synchronizing the rotation of the drawing die 4 i.e. the rotation of the metal tube 14 with the laser irradiation by the laser welding torch 6, a laser can be precisely irradiated on the position of the butt seam in a circumferential direction of the metal tube 14.

By synchronizing the timing of the laser irradiation with that of the feed of the metal tube 14, as shown in FIGS. 3 and 4, the weld parts 25 and 26 welded by a laser can be provided in the proximity of the apertures of the rotation-axis symmetric bodies 22 through which the connecting shafts 23 are inserted.

With the weld parts 25 and 26 welded by a laser provided in the proximity of the apertures of the rotation-axis symmetric bodies 22 through which the connecting shafts 23 are inserted as shown in FIGS. 3 and 4, the tensile load capacity can effectively be increased by welding even if the ball chain is formed by a metal tape with a small wall thickness, and a ball chain with easy processing and reasonable cost can be obtained.

In the example in FIG. 1, the laser welding torch 6 is made to be fixed at a constant position with respect to the ground or a pedestal and synchronized with the rotation of the drawing die 4 to irradiate a laser when the butt seam of the metal tube 14 is rotated to a predetermined position, but the laser welding torch 6 can also be fixed to the drawing die 4 to rotate along with the drawing die 4.

In this case, the laser welding torch 6 is fixed to the drawing die 4 in such a way that a laser is irradiated on the butt seam of the metal tube 14 drawn out of the drawing die 4.

According to this embodiment, a laser can be irradiated intermittently or continuously on the butt seam. By allowing the laser welding torch 6 to perform welding continuously, the weld part can also be provided throughout the length of the butt seam of the metal tube 14.

By allowing the welding to be performed on the entire length of the butt seam of the metal tube 14, a stronger ball chain can be obtained.

What is claimed is:

1. A ball chain including a piece of metal rounded to form metal, hollow and rotation-axis symmetric bodies, each of said rotation-axis symmetric bodies having two diametrically opposed apertures, said rotation-axis symmetric bodies being connected in a chain-like manner with connecting shafts, each of the connecting shafts having two opposing end portions, each of said opposing end portions of the connecting shafts extends through one of the diametrically opposed apertures of one of the rotation-axis symmetric bodies and includes a connecting head, characterized in that each of said rotation-axis symmetric bodies has a butt seam in a direction of a rotation axis of the rotation-axis symmetric body and a weld portion at at least one part of said butt seam.

2. The ball chain according to claim 1, characterized in that said rotation-axis symmetric bodies are hollow balls.

3. The ball chain according to claim 1, characterized in that said weld portion of the butt seam is positioned in a proximity of at least one of the diametrically opposed apertures of each of said rotation-axis symmetric bodies.

4. A method of manufacturing a ball chain characterized by comprising the steps of:

passing a metal wire through a shaft mold to form a connecting shaft wire comprising a plurality of connecting shafts in which each of the plurality of connecting shafts has two opposing ends wherein each of the opposing ends includes a connecting head and each of the connecting shafts is joined to an adjacent one of the plurality of connecting shafts at a shaft joint on each connecting head;

delivering a metal tape and said connecting shaft wire to a drawing die having a positioning means for determining a feed-in position of said connecting shaft wire and a feed-in position and a feed-in angle of said metal tape;

drawing said metal tape using said drawing die to form said metal tape into a metal tube having a longitudinal butt seam with said connecting shaft wire contained coaxially within the metal tube while said drawing die, said metal tape, and said connecting shaft wire are rotated by a predetermined angle;

welding the longitudinal butt seam of said metal tube by irradiating with a laser, or by performing TIG welding, on said longitudinal butt seam in synchronization with a rotation of said metal tube when said longitudinal butt seam of said metal tube is rotated to a predetermined position;

forming said metal tube into a ball chain structure comprising a plurality of rotation-axis symmetric bodies in which each of the plurality of rotation-axis symmetric bodies have two opposing sides and wherein each of the opposing sides are joined to an adjacent one of the plurality of rotation-axis symmetric bodies at a body joint, wherein of each of the plurality of rotation-axis symmetric bodies contains two of the connecting heads with each one of the two connecting heads being from a different one of the plurality of connecting shafts of said connecting shaft wire, by delivering said metal tube and said connecting shaft wire into a body mold and rotating said metal tube and said connecting shaft wire by a predetermined angle; and separating each body joint of said ball chain structure; and separating each shaft joint of said connecting shaft wire.

5. The method of manufacturing a ball chain according to claim 4 characterized in that separating each body joint exposes an aperture in the rotation-axis symmetric bodies, and further comprising feeding the metal tube at a speed and pitch that is synchronized with a timing of said irradiating with a laser, or said performing TIG welding, so that said longitudinal butt seam is welded in a proximity of the aperture in the rotation-axis symmetric bodies.

6. A method of manufacturing a ball chain characterized by comprising the steps of:

passing a metal wire through a shaft mold to form a connecting shaft wire comprising a plurality of connecting shafts in which each of the plurality of connecting shafts has two opposing ends wherein each of the opposing ends includes a connecting head and each of the connecting shafts is joined to an adjacent one of the plurality of connecting shafts at a shaft joint on each connecting head;

delivering a metal tape and said connecting shaft wire to a drawing die having a positioning means for determining a feed-in position of said connecting shaft wire and a feed-in position and a feed-in angle of said metal tape;

drawing said metal tape using said drawing die to form said metal tape into a metal tube having a longitudinal butt seam with said connecting shaft wire contained coaxially within the metal tube while said drawing die, said metal tape, and said connecting shaft wire are rotated by a predetermined angle;

welding the longitudinal butt seam of said metal tube using a laser welding torch, or a TIG welding torch, which rotates together with said drawing die and performs welding from a constant position relative to said drawing die;

forming said metal tube into a ball chain structure comprising a plurality of rotation-axis symmetric bodies in which each of the plurality of rotation-axis symmetric bodies have two opposing sides and wherein each of the opposing sides are joined to an adjacent one of the plurality of rotation-axis symmetric bodies at a body joint, wherein of each of the plurality of rotation-axis symmetric bodies contains two of the connecting heads with each one of the two connecting heads being from a different one of the plurality of connecting shafts of said connecting shaft wire, by delivering said metal tube and said connecting shaft wire into a body mold and rotating said metal tube and said connecting shaft wire by a predetermined angle; and separating each body joint of said ball chain structure; and separating each shaft joint of said connecting shaft wire.

7. The method of manufacturing a ball chain according to claim 4 characterized in that said welding the longitudinal butt seam occurs continuously or intermittently.

8. The method of manufacturing a ball chain according to claim 6 characterized in that said welding the longitudinal butt seam occurs continuously or intermittently.

* * * * *